United States Patent [19]

Feldmann et al.

[11] Patent Number: 4,828,581

[45] Date of Patent: May 9, 1989

[54] LOW INLET GAS VELOCITY HIGH THROUGHPUT BIOMASS GASIFIER

[75] Inventors: Herman F. Feldmann, Worthington; Mark A. Paisley, Upper Arlington, both of Ohio

[73] Assignee: Battelle Development Corporation, Columbus, Ohio

[21] Appl. No.: 115,463

[22] Filed: Oct. 30, 1987

Related U.S. Application Data

[63] Continuation-in-part of Ser. No. 7,168, Jan. 22, 1987, which is a continuation-in-part of Ser. No. 778,345, Sep. 20, 1985, abandoned.

[51] Int. Cl.[4] ..... C10J 3/46; C10J 3/54

[52] U.S. Cl. ..... 48/197 R; 48/202; 48/209

[58] Field of Search ..... 48/197 R, 202, 203, 48/206, 209, 210; 580/733

[56] References Cited

U.S. PATENT DOCUMENTS

| | | | |
|---|---|---|---|
| 3,736,111 | 5/1973 | Gardner et al. | 48/209 |
| 3,853,498 | 12/1974 | Bailie | 48/209 |
| 4,592,762 | 6/1986 | Babu et al. | 48/203 |

FOREIGN PATENT DOCUMENTS

| | | | |
|---|---|---|---|
| 2643298 | 4/1978 | Fed. Rep. of Germany | 48/206 |

OTHER PUBLICATIONS

Chan et al., "Modeling of Physical and Chemical Processes During Pyrolysis of a Large Biomass Pellet with Experimental Verification", ACS, Div. of Fuel Chem., vol. 28, No. 5, Aug. 1983, pp. 330–337.

*Primary Examiner*—Peter Kratz
*Attorney, Agent, or Firm*—Klaus H. Wiesmann; Benjamin Mieliulis

[57] ABSTRACT

The present invention discloses a novel method of operating a gasifier for production of fuel gas from carbonaceous fuels. The process disclosed enables operating in an entrained mode using inlet gas velocities of less than 7 feet per second, feedstock throughputs exceeding 4000 lbs/ft$^2$-hr, and pressures below 100 psia.

8 Claims, 4 Drawing Sheets

LOW INLET GAS VELOCITY HIGH THROUGHPUT BIOMASS GASIFIER

STATEMENT OF GOVERNMENTAL RIGHTS

This invention was made with government support under Contract No. DE-AC06-76RLO 1830 awarded by the U.S. Department of Energy. The government has certain rights in the invention.

This application is a continuation-in-part of Ser. No. 007,168 filed Jan. 22, 1987 now abandoned, which is a continuation-in-part of Serial No. 778,345 filed Sept. 20, 1985 now abandoned.

BACKGROUND OF INVENTION

This invention relates to gasifiers as applied to biomass gasification for the production of a medium Btu grade fuel gas from a variety of biomass forms including shredded bark, wood chips, sawdust, sludges and other carbonaceous fuels or feedstocks.

The process system according to this invention relates to production of gas by use of a high throughput gasifier employing hot sand circulation for process heat. As is known in the art, the exothermic combustion reactions can be separated from the endothermic gasification reactions. The exothermic combustion reactions can take place in or near the combustor while the endothermic gasification reactions take place in the gasifier. This separation of endothermic and exothermic processes results in a high energy density product gas without the nitrogen dilution present in conventional air-blown gasification systems.

The present invention relates to a novel method of operating a gasifier preferably for a parallel entrained bed pyrolysis unit, i.e., a system comprising an endothermic reaction zone distinct from the exothermic reaction zone of the combustor wherein the heat from the exothermic zone is transferred to the endothermic reaction zone by circulation of an inert particulate solid such as sand. To be able to operate a gasifier in an entrained mode while using only low inlet gas velocities and at very high fuel feed rates would be an advance in the art and of commercial significance. The process disclosed by the present invention enables operating at inlet velocities typical of fluidized beds but operating in an entrained mode and with extraordinary thoughputs with fuel feed rates far above those contemplated as possible based on existing art.

The novelty and unexpectedness of the present invention can be readily ascertained by an examination of existing fluidization design equations and published literature information on the rates of biomass conversion to gas, particularly as regards the prediction of the design of a conceptual biomass gasifier operating at the conditions taught by the present invention.

Incorporated herein by specific reference is Chan, R. and Krieger, B. B., "Modeling of Physical and Chemical Processes During Pyrolysis of a Large Biomass Pellet with Experimental Verification", American Chemical Society, Division of Fuel Chemistry Preprints Volume 28, No. 5, August 1983, pp. 330–337 and in particular FIGS. 2 and 3 set forth therein.

The data on the rate of conversion of biomass to gas published by Chan and Krieger is used to estimate the residence time required to convert a substantial fraction of biomass to gas. The gas generation rate depends on the time the particle is exposed to approximately the same heat flux as used in a constant 1500 to 1600 F. fluid bed.

According to the published data of Chan and Krieger, to gasify woods chips should require, to dry, heat up, and pyrolize the wood, on the order of 2 to 3 minutes residence time in the gasifier. Heat balance calculations indicate that to provide the heat for gasification approximately 15 pounds of sand must be circulated per pound of wood gasified.

With this information, estimation can be made of the dimensions of a fluid-bed reactor to gasify wood. Sizing of a fluid bed using the prior art to predict the dimensions a fluid bed would have to have to operate at the high biomass throughputs taught by this invention will make all the more apparent the novelty and unobviousness of this invention.

Since wood and sand are constantly fed to the gasifier with sand and char withdrawn also at a constant rate, the residence time of wood and sand are equal. Because the sand does not react or change in weight, the sand flow and sand inventory in the reactor provide the design basis.

The residence time of wood and sand in the fluid bed is given by $$t = \frac{\text{Sand Inventory}}{\text{Sand Feed Rate}} = \frac{\text{lbs}}{\text{lbs/min}}$$

The sand and inventory in the bed is given by $$\rho_B h_B A_B$$

where $\rho_B$=sand density at fluidization conditions, lbs/ft$^3$ $h_B$=fluid bed height, ft $A_B$=cross sectional area of the fluid bed, ft$^2$.

The sand feed rate is given by $$W_S(\text{lbs/hr}) = W_{So}(\text{lbs/ft}^2\text{-hr})A_B(\text{ft}^2).$$

$W_{So}$ is the specific sand throughput and determines the fluid-bed cross sectional area required to achieve the total sand feed rate which in turn is related to the wood rate by the heat balance. As mentioned, the heat balance requires approximately 15 pounds of sand per pound of wood. If one selects a wood throughput demonstrated to be feasible by this invention, for example, $W_{Wo}$=2000 lbs/ft$^2$-hr where $W_{Wo}$ is the specific wood throughput, it is possible to estimate the fluid-bed height required to provide the necessary 2 to 3 minutes residence time. The expression for the residence time in terms of the above parameters is given by $$t = \frac{\rho_B h_B A_B}{W_{So} A_B} = \frac{\rho_B h_B}{W_{So}}$$

$$\text{Since } W_{So} = 15\ W_{Wo} = 15\left(2000\ \text{lbs/ft}^2\text{-hr} \times \frac{1\ \text{hr}}{60\ \text{min}}\right)$$

$$W_{So} = 500\ \text{lbs/ft}^2\text{-min}$$

A reasonable value for the bulk density of a well fluidized bed of sand is common knowledge in the art and given by several fluidization texts at approximately 30 lbs/ft$^3$.

Substituting in the above equation $$3 \text{ minutes} = \frac{30 \text{ lbs/ft}^3 \times h_B \text{ (ft)}}{500 \text{ lbs/ft}^2\text{-min}}$$

indicates a bed height of approximately $$h_B = \frac{3 \text{ min} \times 500 \text{ lbs/ft}^2\text{-min}}{30 \text{ lbs/ft}^3} = 50 \text{ ft}$$

would be required to provide the needed residence time at the high biomass throughputs taught by this invention. It is, however, well known by anyone familiar with fluidization technology that "slugging" occurs with long skinny fluid beds. The maximum fluid bed height to diameter ratio to avoid slugging is $h/D=6$ and preferably a ratio $2<h/D<6$ is recommended for good fluidization.

Unlike the teachings of the prior art, the present invention is able to gasify 2000 lbs/ft$^2$-hr and even exceed 4500 lb/ft$^2$-hr through a unit of 10 inch (0.83 ft) diameter and length of 22 feet. Further, the operation is smooth and without any evidence of slugging. The present invention is therefore a radical departure from the teachings and conventional wisdom of the prior art. The prior fluidized bed art teaches away from this invention.

DESCRIPTION OF RELATED ART

Bailie, U.S. Pat. No. 3,853,498 describes a process involving separate gasification and combustion zones. In the Bailie process, both zones are conventional fluid-bed reactors. Published wood throughput values for the Bailie process typically do not exceed 120 lbs/ft$^2$-hr. Fluidization would occur typically with inlet gas velocities 1–3 ft/sec to provide good fluidization. Since the Bailie process employs conventional fluid-beds, transfer of circulating sand is by direct flow from fluid-bed to fluid-bed rather than by entrainment and exit out the top of the reaction vessel.

Squires U.S. Pat. No. 4,032,305 discloses another circulating bed gasifier for coal and coke gasification known as a "fast fluid-bed". The fast fluid-bed can operate in a two-zone configuration of an exothermic combustion zone and an endothermic gasification zone. Squires states that the minimum velocity to achieve a circulating fast fluid-bed is a little more than 6 ft/sec with particles having an average diameter of 60 microns. Squires prefers operating with particles no larger than 250 microns.

The present invention uses particles typically of 20–1000 and preferably 300–800 microns. Scaling the 6 ft/sec minimum velocity recommended by Squires based on finer particles to the coarser particles of this invention, one would estimate a minimum velocity of 30 ft/sec would be required to achieve fast fluid-bed conditions.

Both entrained and fluidized gasification presents a variety of advantages including low capital equipment costs, low maintenance, flexibility, ease of control and high conversion efficiency. There are few moving parts thus design and assembly are greatly simplified.

It is an object of the present invention to disclose a gasifier operating in the entrained mode but using inlet velocities characteristic typically only of fluidized beds and capable of operating at fuel feedrates much higher than contemplated possible by the existing art. It is an object of the present invention to disclose such a gasifier having throughputs that can approach or exceed from 500–4400 lb/ft$^2$-hr.

The gasifier according to the present invention operates in the entrained mode but at inlet gas velocities below and wood throughputs that are well beyond what would be expected based on a knowledge of the prior art. In spite of the fact that the system operates at inlet velocities typical of fluid-beds, the reactor operates in the entrained mode.

SUMMARY OF THE INVENTION

This invention comprises the unexpected discovery that it is possible to gasify biomass at very high wood throughputs but in an entrained gasifier operating at low inlet gas velocities.

Entrainment rates in order to operate in an entrained mode, it had been believed, depended to lesser or greater degrees on a large number of complexly interrelated varibles including particle size, density, uniformity of particles, column diameter, baffling, bed depth, but primariy it was believed on high inlet gas velocity.

Though the fast fluidized bed is recognized as having much higher processing capacities than a bubbling fluidized bed, this type of bed typically required air inlet exceeding 30 ft/sec. What makes this invention all the remarkable is that applicant has achieved entrainment of inert solids, not merely bubbling fluidization, in a parallel entrained bed pyrolysis process at an inlet velocity of as low as 0.5 ft/sec but with a wood throughput from 500 to 4400 lbs/ft$^2$-hr. The lbs/ft$^2$-hr relates to the gasifier diameter by referring to the cross-sectional area of the gasifier.

DETAILED DESCRIPTION

The gasifier according to our invention is basically a reactor with a fluid-bed of sand at the reactor base operated at wood feed rates sufficiently high to generate enough product gas to circulate sand and gasified char by entrainment.

The gasifier is essentially a hybrid with an entrained zone above a fluidized bed gasifier.

Figure 4:
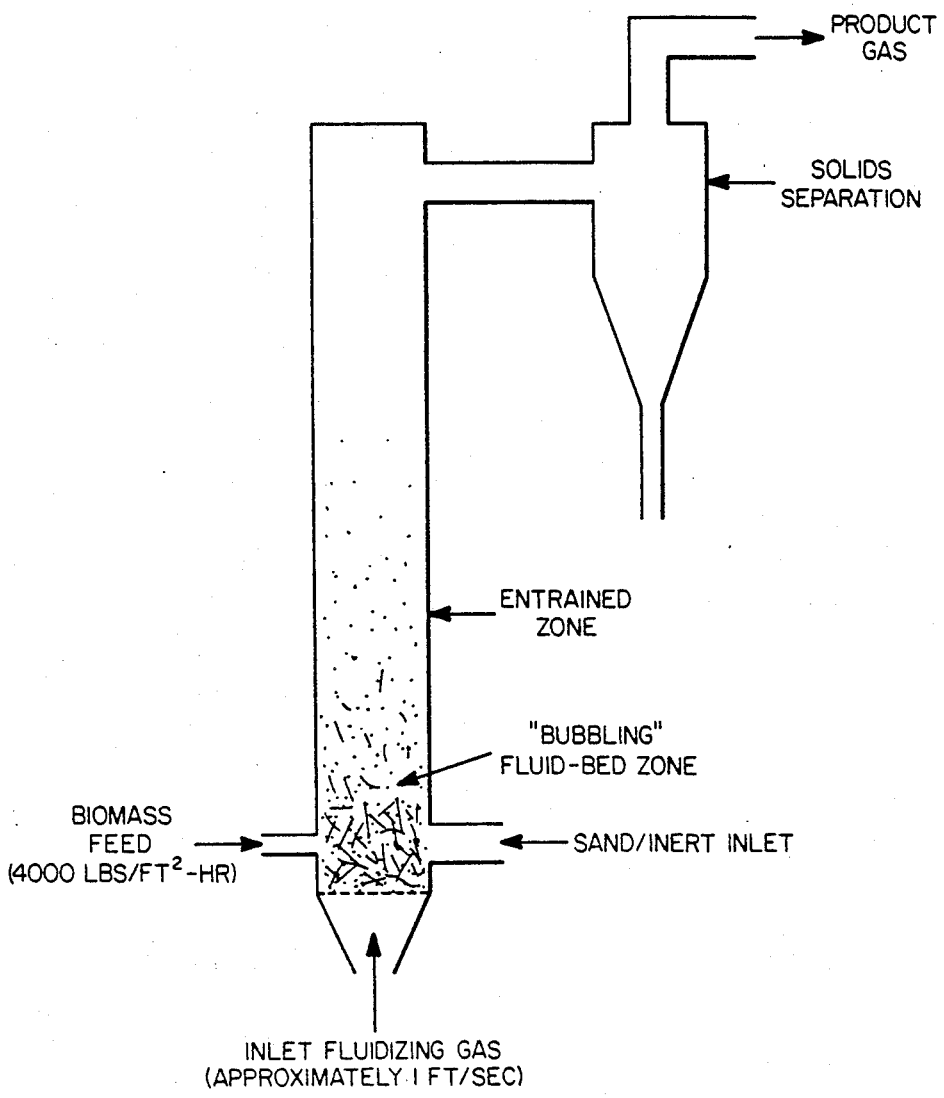
FIG. 4 is a sketch of a gasifier useful in the process according to this invention. The depicted cyclone separator can inertially remove entrained solids, thus the gasifier optionally can be coupled to various made combustors including fast fluid, bubbling fluidized, multi-solid fluidized and entrained solid.

This gasifier would have the features illustrated in FIG. 4. In FIG. 4, the annular shaped gasifier vessel has a conventional gas distribution plate near the bottom and there at has openings for biomass feedstock entry, inert material circulation or recirculation, and fluidizing gas inletting. The reaction vessel has an exit at or near the top leading to a separator from which product gas is discharged and solids are recycled to the bottom of the gasifier or preferably recycled via an exothermic combustor to reheat the inert material.

The biomass gasifier operates with a recirculating particulate phase and at inlet gas velocities in the range required to fluidize the sand or other recirculating particulate phase. For example, a velocity of 0.8 to 2 ft/sec with a 20×50 mesh sand has allowed smooth stable operation. Velocities of 0.5 to 7 ft/sec can be used.

The biomass gasifier operates at wood feed rates that exceed 3000 lbs/hr of dry biomass per square foot of reactor cross sectional area. Throughputs of 4400 lbs-ft$^2$/hr are achievable and possibly even higher. The inlet for wood feed and recirculating sand is located at the base of the reactor in the neighborhood of the gas distributor. The gasifier has provision for removal of the circulating particulate phase and char by entrainment. Separation of the entrained particulate phase, such as sand and char from the product gas, can be accomplished by conventional cyclone(s). Surprisingly, all system solids are elutriated by this process despite the low inlet gas velocities used.

Figure 1A:
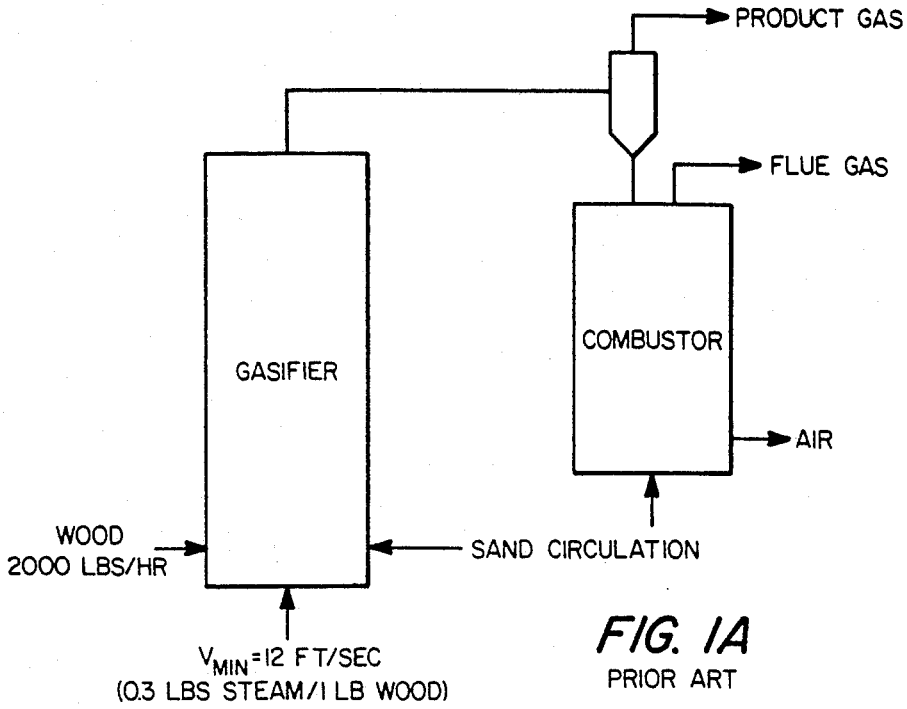
FIG. 1A PRIOR ART
FIGS. 1A, 1B, and 1C are sketches of gasifier systems according to the prior art.
Figure 1B:
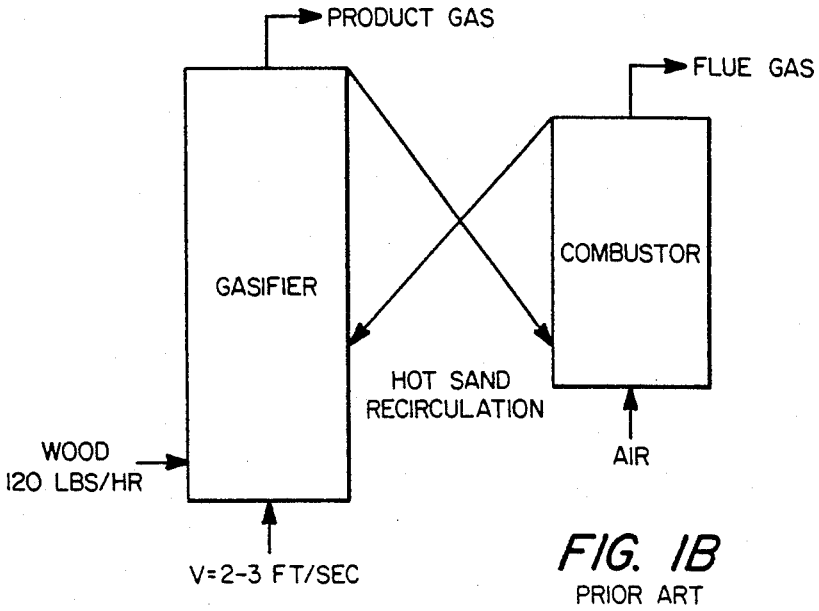
FIG. 1B PRIOR ART
Figure 1C:
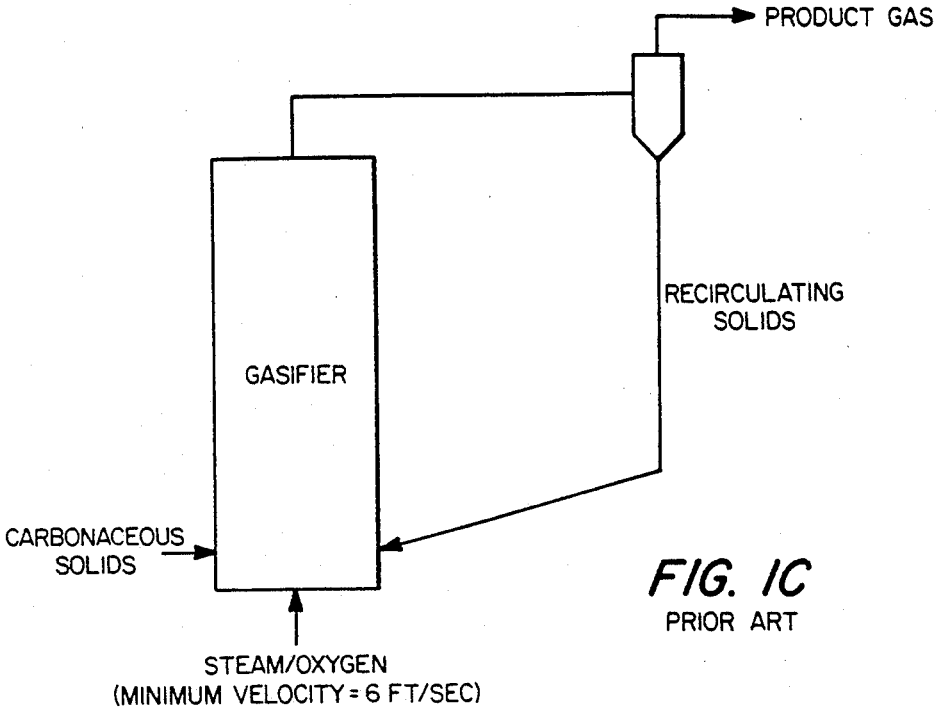
FIG. 1C PRIOR ART
Figure 2:
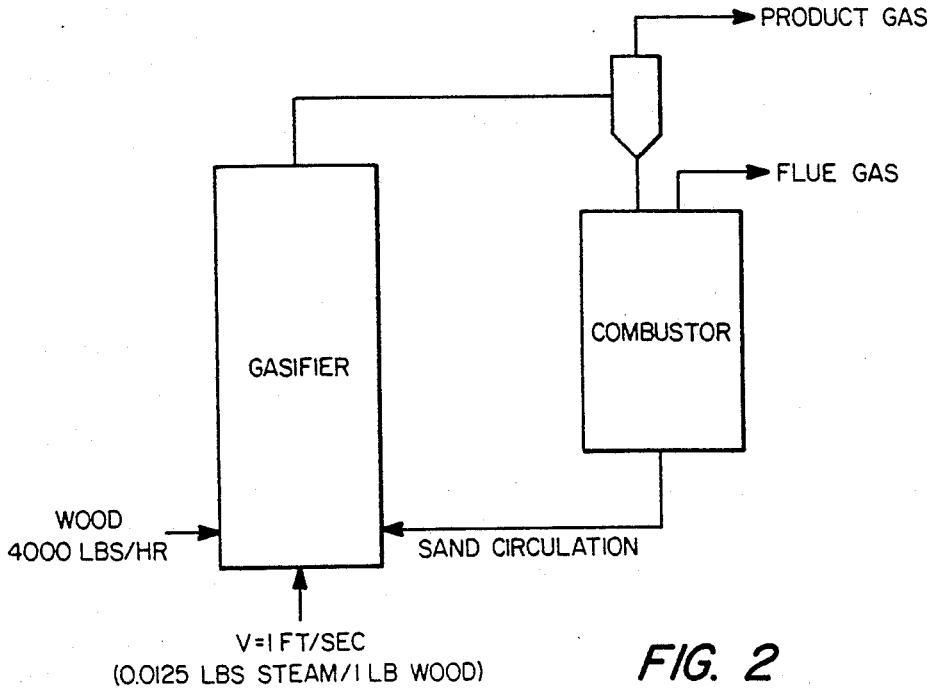
FIG. 2 is a sketch of a gasifier system according to this invention depicted coupled with a typical parallel entrained bed pyrolysis unit.
Figure 3:
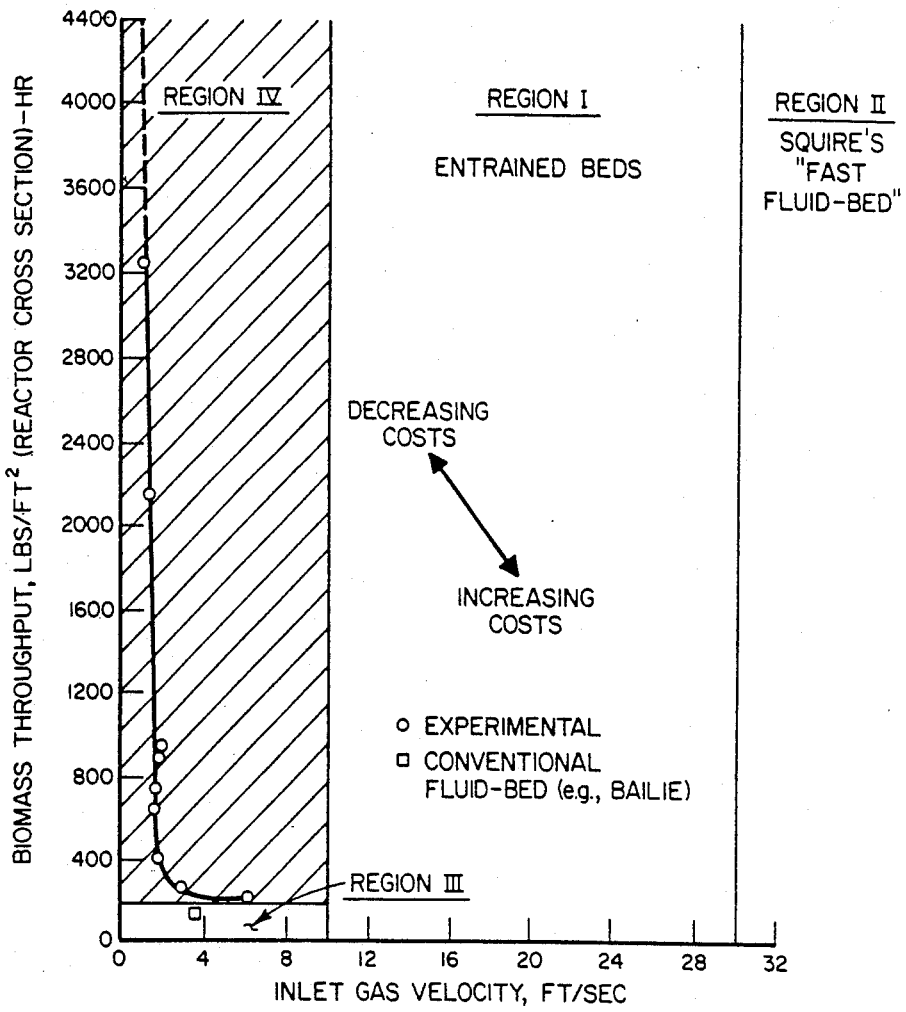
FIG. 3 is a graph of biomass throughput via inlet gas velocity. The graph highlights the present invention's unique capability of operating in the region termed "Region IV" corresponding to high biomass throughput and low inlet gas velocity.

Looking now at FIG. 3, which describes generic fluid-particle gasification regimes in terms of input gas velocities and solids throughput, the low inlet gas velocity high throughput biomass gasifier of the present invention operates with biomass throughputs of from 200 and preferably 500–4400 lb/ft$^2$-hr but with inlet gas velocities of 0.5–7 ft/sec. This operating range corresponds approximately with Region IV of the graph.

Region I visualizes the operating parameters known to the art for conventional entrained beds. Such beds in practice are bounded by a biomass throughput of 2000 lb/ft$^2$-hr and a minimum inlet velocity of 10–12 ft/sec up to approximately 30 ft/sec.

Region II illustrates the operating region of "fast fluid-beds". To achieve the bed density necessary for a fast fluid-bed a minimum solids circulation rate is usually required. Region II includes the transport velocities commonly used in vertical pneumatic conveying of particulate material. This is the typical operating region of entrained systems regardless of the wood throughput.

Region III illustrates the operating region of conventional fluid-beds. Such beds do not operate in the entrained mode. Experience at throughputs above 200 lb/ft$^2$-hr near atmospheric pressure is unavailable to date for conventional fluids-beds.

The method of operating a gasifier according to this invention comprises introducing inlet gas at a gas velocity not exceeding 7 ft/sec to fluidize a high average density bed in a gasifier vessel. The high average density bed in formed into a dense fluidized bed in a first space region by means of the inlet gas. The dense fluidized bed contains a circulating first heated relatively fine and inert solid bed particle component. Carbonaceous material is inputted into the first space region with dense fluidized bed at a rate from 200 and preferably 500–4400 lbs/ft$^2$-hr and endothermal pyrolysis of the carbonaceous material is accomplished by means of the circulating heated inert material so as to form a product gas. Contiguous to and above the dense fluidized bed a lower average density entrained space region is formed containing an entrained mixture of inert solid particles, char and carbonaceous material and the product gas. The entrained mixture is then removed from the entrained space region of the gasifier to a separator such as a cyclone wherein the entrained mixture of inert solid particles, char and carbonaceous material is separated from the product gas. Residence time of the carbonaceous material in the gasifier does not exceed 3 minutes on average. Finally, at least the inert solid particles are returned to the first space region after passage through an exothermic reaction zone such as a combustor to first heat the inert particles. To facilitate the exothermic reaction, it can be advantageous to route the entire entrained mixture absent product gas through the combustor.

In this invention a fluidized bed of heated sand or other relatively inert material at the lower end of the gasifier vessel forms a region of relatively high density. Inputted wood or other carbonaceous material, being lighter than the sand, floats on the fluidized sand. As the wood is gasified by the hot sand, an entrained region of sand, char and carbonaceous particles forms in the upper end of the gasifier vessel.

The highest concentration of entrained wood and char would be found at the top of the densely fluidized zone within the gasifier vessel. Entrained hot sand circulates through the entrained wood and char. As the carbonaceous particles pyrolyze, they generate gas forming a high velocity region above the fluidized bed. Despite a low gas inlet velocity below the bed the gas velocity above the fluidized bed becomes high enough to actually remove particles from the bed.

By operating at low inlet gas velocity, high residence time (up to 3 minutes on average) in the reaction vessel can be achieved while surprisingly still having high throughputs of carbonaceous material generating gas to form the entrained region above the fluidized region.

In this system, unlike the prior art, all system solids are removed from the top of the vessel, and removed from the system only by entrainment despite the low inlet gas velocities below the bed. This is possible by the design of using a fluidized region above which is an entrained region from which all bed particles including inerts and char are removed. Entrainment occurs in part because of the gas generated in situ contributing significantly to the volume of gas moving through the reaction vessel, while avoiding the destructive slugging predicted by the prior art for conventional fluidized beds if operated under the invention's parameters.

The carbonaceous material fed to the gasifier has upwards of 60% of the available carbon converted upon a single pass through the gasifier system. The remainder of the carbon is burned in the combustor to generate heat for the pyrolyses reaction. If other fuel is used in the combustor, then additional carbon can be converted in the gasifier. With wet fuels, such as muncipal waste, carbon conversions might vary upward or downward depending on the operating temperature of the gasifier.

The inlet gas fed to the gasifier typically can be steam, recycled-product-gas, combustion by-product gas, inert gases such as nitrogen, and mixtures thereof. Preferred gases for the invention are steam and recycled-product-gas. Addition of other gases such as inert gases or combustion by-product gases will reduce the efficiency and advantages of the invention. Likewise, the addition of air or oxygen reduces the efficiency and advantages of the invention and should not be used.

In the Table the inert gas used was nitrogen. The whole purpose in using nitrogen for these tests was to find out whether it is necessary to use a reacting gas such as steam. Prior art such as Babu must add steam together with oxygen to convert the biomass. Test demonstrated that any gas including inert gases will also provide the same results. Steam is a convenient gas because it is relatively cheap and can be condensed from the product gas prior to distribution. Nitrogen, on the other hand, while allowing the same carbon conversion and the same product gas distribution remains in the product gas as diluent thereby reducing its utilization value.

Air or oxygen are not used because the heat required to gasify the feed is introduced by the hot circulating inert solids whereas in some prior art systems the oxygen burns a portion of the char and product gases to provide heat. This reduces the utilization value of the product gas.

Operation at elevated pressure is necessary for the prior art to achieve higher feed throughputs. There are two real design constraints to increase the solids throughput to the level taught in the prior art. (The L/D ratio is a design constraint but is not associated with throughput). The first constraint is that every pound of feed requires a fixed ratio of steam and oxygen to gasify the feed. The second constraint is that the fluidization velocity cannot exceed a certain value, which at high temperature, is essentially independent of pressure. Thus, if the prior art were to attempt to throughput biomass at values significantly higher than the 120 pounds per square feet per hour typical for conventional fluid beds, the steam and oxygen flow would have to increase and soon would be in a position where excessive bed elutriation would occur.

In a conventional fluid bed, the only way to satisfy the above two constraints is by increasing the pressure. At the higher pressure, the compression of the feed gas allows more molecules of gas per unit volume. This can be clearly illustrated by application of the ideal gas law, $PV=nRT$ where P is the absolute pressure, V the volume, n the number of moles of gas (proportional to the number of molecules), R is a gas constaint, whose value depends on the units employed, and T is the absolute temperature.

The gas velocity is given by the equation V/A where V is the volumetric flow rate of gas at the conditions existing in the reactor and A is the reactor cross sectional area. Thus, the gaseous flow rate is given by the following equation $(n/A)=P(V/A)/RT$.

To achieve higher throughputs in a conventional fluid bed requires being able to feed more gas per unit of reactor cross section (n/A). In addition, since the fluidization gas velocities (V/A) do not change appreciably with pressure, the only way to increase n/A at an essentially constant value of V/A is by increasing the pressure P. Thus, by operating at 200 psig (the lowest pressure taught in the patent) one would expect a nearly 15 fold increase in throughput. (Actually the variation depends on sand particle size and the throughput factor can be between 5 and 15 at the 200 psig pressure compared to atmospheric pressure). The present invention is different from the prior art in that a reacting gas is not added to the gasifier. Instead, the inlet gas to the gasifier is used only to provide physical mixing of the incoming sand and feed. Further pressure is not a design constraint with the present invention. In the present invention throughput is independent of pressure allowing operation at low pressures. The lower pressures result in reduced costs for the system. Pressures of between atmospheric and 100 psia may be used although lower pressures such as between atmospheric and 30 psia are preferred.

In the design of a conventional fluidized bed, entrainment of particles to the cyclone is considered deleterious to performance of the system. Loss by entrainment is sought to be avoided or, if unavoidable, minimized as much as possible. Thus, a typical fluidized bed is designed such that enough space above the bed is provided to allow lifted particles to settle in the vessel. This space must be provided for in the height of the gasifier vessel and is referred to as transport disengagement height or free board space.

The present invention teaches how to use entrainment to beneficial advantage to obtain high carbonaceous feedstock throughput. Commercial advantage of this invention becomes immediately apparent as more throughput means higher production levels through the same or smaller sized equipment, thus a significant reduction in capital costs results from this technology.

In this invention entrained material exits the vessel near the top of the gasifier to a cyclone or other inertial settling device for separating the product gas from the char, carbonaceous material and inert material. All system solids are entrained except for unwanted tramp material such as scrap metal inadvertently introduced with the fuel feedstock, for which a separate cleanout provision may be needed.

The system of the present invention is versatile and could be combined with any type of combustor, fluidized, entrained, or non-fluidized, for heating the inert material. The inert material can be heated by passage through an exothermic reaction zone of a combustor to add heat. The inert material is understood to mean relatively inert as compared to the carbonaceous material and could include sand, limestone, and other calcites or oxides such as iron oxide. Some of these "relatively inert materials" actually could participate as reactants or catalytic agents, thus "relatively inert" is used as a comparison to the carbonaceous materials and is not used herein in a strict or pure qualitative chemical sense as commonly applied to the noble gases. For example, in coal gasification, limestone is useful as a means for capturing sulfur to reduce sulfate emissions. Limestone might also be useful in catalytic cracking of tar in the gasifier.

The unexpectedness of this invention is reflected from the realization that the invention cannot be arrived at by mere high input of carbonaceous material to a fluidized bed. The prior art theoretical limits as to slugging teaches that operating at fluidization velocity, the addition or throughput of more and more carbonaceous materials eventually results in an L/D ratio in excess of 2–6 giving rise to slugging, vibration and ultimately self destruction of the containment vessel. The prior art teaches completely away from the present invention.

In this invention, we have discovered that an unexpected operating relationship can exist between wood feed rate or throughput and inlet gas velocity. This relationship indicates the higher the wood feed rate, the lower the inlet gas velocity that can be tolerated. We have been successful in combining both extremely high wood throughputs with low inlet gas velocities. The combination of low inlet gas velocity and high wood feed rates provide the basis for the design of a biomass gasifier that is not only completely unanticipated based on existing information but also could not be arrived at through assembling of various combinations of available data.

Our experimental work has demonstrated that biomass conversion results in sufficient gas generation to transport the sand/char suspension through the reactor and to maintain a sufficiently low suspension density at the gasifier base to allow the hot sand from the combustor to continually flow into the gasifier from the combustor. That the system would behave in this fashion is completely unpredictable based on existing knowledge as has been demonstrated in the previous calculations illustrating the application of available fluid-bed design criteria and biomass gasification data. As was demonstrated, assuming the system is operating in the conventional fluid-bed mode in the manner of Bailie, then, to transfer the hot sand into the fluid-bed requires that the sand overcome a head of $\rho_{fb}h_{fb}$ where $\rho_{fb}$ is the fluid-bed density and $h_{fb}$ is the fluid-bed height. Assuming that a wood residence time on the order of 3 minutes is required to dry, heat up, and pyrolyze the wood, and with the sand/wood ratio necessary to provide the heat for gasification, a simple calculation predicts that it would be impossible to maintain sand flow against the static pressure in the gasifier at wood feed rates far lower than those covered by our present invention. For example, at a wood throughput of 2000 lbs/ft$^2$-hr, and assuming a typical fluid-bed density of 30 lbs/ft$^3$, $h_{fb}$ would be 50 ft (the experimental gasifier has a total height of only 22 ft). In addition, these high wood throughputs would require fluid-beds with L/D (bed length to diameter) ratios far exceeding those at which fluid-beds can be smoothly operated. For example, fluidization tests predict the onset of slugging, which causes severe vibration in fluid-beds, when the fluid-bed L/D exceeds a value of 2 to 6 depending on particle size. Thus, one "skilled in the art" of both biomass gasification and fluid-beds would predict that the proposed invention would not work.

The L/D ratio, while a design constraint, in the conventional fluid bed taught by the prior art is not a design constraint in the present invention. The L/D ratio is a critical design parameter in a conventional fluid bed because it lower limit of about 2 is necessary to provide thorough mixing. However, as the L/D ratio is increased to more than 5 or 6, the reactor will start to vibrate as the gas bubbles grow to a size large enough to cause severe "hiccuping". These vibrations have caused commercial fluid beds to literally self-destruct as the foundations supporting them have been broken loose.

Thus, the present invention which operates without this constraint represents a considerable departure from what conventional fluid bed technology teaches. This has been clearly demonstrated by tests conducted at L/D ratios of over 20/1.

The height of the gasifier must be sufficient to permit complete pyrolysis of the upward flowing carbonaceous material at the contemplated throughput rates. The emerging char elected from the gasifier must have sufficient heat to satisfy heat requirements for gasification. In the present invention a height of 22 feet was found to be sufficient. This adequacy of height for a particular gasifier can be easily determined once knowing the teachings of the invention.

Since the system described in this invention has been successfully reduced to practice and does work, it is interesting to speculate on what is actually occurring in the gasifier when it is operated at inlet velocities insufficient to entrain the sand but at high throughputs. At low inlet gas velocities, it is probably reasonable to speculate that a short fluid-bed exists at the base of the gasifier. Fresh wood and hot sand from the combustor enter below the surface of the fluidized zone of the reactor. Because of the low density of the wood and char, it is reasonable to expect a much higher concentration of wood and char to be floating on the surface of the fluid-bed than is randomly circulating within the bed. Sand however circulates randomly in the fluidized zone thereby transferring heat to the "floating" wood. Since the concentration of wood and char is highest at the top of the fluid-bed, most of the gas will be generated there. This means that entrainment will occur from the top of the fluid-bed zone because of the high local gas velocities.

The discovery that it is possible to operate using a low inlet gas velocity and high biomass throughput and maintain a steady-state inventory in the reactor with removal of sand and char by entrainment allows a very substantial improvement over the existing art.

EXAMPLES

1. Gasifier Coupled to Fluid Bed Combustor

A process research unit (PRU) was assembled. The system consisted of a 10 inch I.D. gasifier coupled to a 40 inch I.D. combustor. The gasifier and all connecting piping was constructed without refractory linings to reduce start-up and cool down time as well as the time required to reach steady state. All the components of a commercial-scale system are included in the PRU allowing the system to be operated in a completely integrated fashion. The PRU combustor is oversized to ensure that the gasifier, which receives all its heat from the circulating entrained solids phase, can be maintained at a temperature sufficient to achieve the desired gasification conversions. Natural gas is added to help balance the large heat losses inherent in a small-scale system.

The gasifier reactor is designed to operate up to 1600 F. and 5 psig (though it has been operated at pressures up to 15 psig). Entrained sand and char are separated from the product gas in a disengager and returned to the combustor. Char produced in the gasifier is consumed in the combustor to heat the sand phase. The combustor is a conventional fluid bed designed to operate at 1900 F.

Typically as-received or partially dried wood chips are charged to a feed hopper. A bed of silica sand is placed in the conventional fluid bed combustor and fluidized with air at a linear velocity of about 1.5 ft/sec. After smooth fluidization is established, a startup natural gas burner is ignited. This burner serves as an air heater and is used to preheat the bed to a temperature sufficient to combust char. The startup burner has a total heat input of 1 million Btu/hr. The wood feed rate is controlled by four metering screws located below the wood feed hopper. These screws empty into another larger horizontal conveying screw which, in turn, empties into a vertical conveying screw. The wood chips then fall into the gasifier.

Adjustments to gas flows or system pressure (nominally 5 psig) are made remotely from the control room.

The PRU system can be operated at wood feed rates from 50 to in excess of 2500 lb/hr. Larger commercial systems readily achieve significantly higher wood feed rates. Expressed as lb/ft$^2$-hr 2500 lb/hr through a circular 10" I.D. gasifier, is the same as 2500 lb/hr through an area [($\pi r^2$) i.e., $\pi(5/12)^2$] of 0.545 sq. ft.

$$2500/0.545 = x/l$$

$$x = 4584 \text{ lb/ft}^2\text{-hr}$$

Design specifications for the PRU system are:
Gasifier

Size: 10 in. I.D.=22 ft long
Temperature: 1600 F.
Pressure: 20 psia
Combustor
Type: Fluidized bed
Fuel: Natural gas in addition to wood char
Temperature: 1900 F.
Size: 40 in. I.D.×11 ft long
Feed Rate
Wood: 50–2500 lb/hr i.e., (90–4600 lbs/ft$^2$-hr)
Heating Value of Product: 475 Btu/SCF (dry)
Heat Carrier: silica sand
Gasifying Medium: steam or inert gas
Fuels Utilized Thus Far:
(without pretreatment or size reduction)
coarsly shredded bark
wood chips
sawdust
hog fuel
whole tree chips 2. Additional Demonstrations of the Feasibility of Operating at Low inlet Gas Velocities and High Biomass Throughputs

| RUN NUMBER | 3.2B | 5.4B | 5.5A | 5.5B | 5.5C |
|---|---|---|---|---|---|
| DATE | 06/10/83 | 3/6/85 | 3/14/85 | 3/14/85 | 3/14/85 |
| DRY FEED RATE, LB/HR | 746 | 1814 | 485 | 1175 | 1775 |
| SPECIFIC WOOD RATE, LB/HR-FT2 | 1368.53 | 3327.58 | 889.01 | 2156.04 | 3256.95 |
| GASIFIER FEED GAS | INERT | STEAM | INERT | INERT | INERT |
| GASIFIER TEMPERATURE, F. | 1167 | 1512 | 1750 | 1663 | 1618 |
| GASIFIER GAS VELOCITY, FT/SEC | 2.53 | .82 | 1.75 | 1.34 | .82 |
| COMBUSTOR TEMPERATURE, F. | 1576 | 1959 | 1981 | 1980 | 1910 |
| COMBUSTER GAS VELOCITY, FT/SEC | 1.43 | 2.79 | 2.19 | 2.08 | 2.09 |
| CARBON CONVERSION TO GAS, % | 31.88 | 62.38 | 78.12 | 71.34 | 66.87 |
| PRODUCT GAS HHV, BTU/SCF | 406 | 485 | 460 | 483 | 484 |

NOTE: MINIMUM FLUIDIZATION VELOCITY OF SAND = 0.2 FT/SEC

It will be evident to those skilled in the art that start-up of the gasifier for example coupled to a combustor would involve the stages of heat-up and initiation of gasification. These stages could be comprised as follows:

A. Start-Up

Natural gas or some other fuel, which could be wood, is ignited in the combustor and burned at a rate sufficient to increase the combustor temperature at a rate which will not induce spalling of the ceramic lining. Circulation of sand is then initiated between the gasifier and combustor to heat-up the gasifier. During the heat-up stage, air can be used as the transport gas in both gasifier and combustor. Gas velocities and wood throughputs in both the gasifier and combustor must be sufficient to entrain the sand to allow for its circulation between gasifier and combustor. This would require a gas velocity on the order of 15 ft/sec with the sand particle size range that we employ. The combustion of an auxiliary fuel and circulation of the hot sand is continued until the gasifier reaches the desired temperature (about 1700 to 1800 F.).

B. Initiation of Gasification

After the gasifier reaches the desired 1700 to 1800 F., at this time the feed gas to the gasifier is switched from air to steam and then, if desired, to recycle product gas. Wood feed is initiated and the wood feed rate gradually increased. As the wood gasifies, char is produced which is transported to the combustor where it is burned to replace the start-up fuel. As the wood feed rate is increased, the feed gas (steam or recycle product gas) to the gasifier is gradually reduced until the system is operating in the range of gas velocities not exceeding 7 ft/sec.

While wood and wood derivatives have been specifically discussed herein other carbonaceous materials will also work in the invention. All cellulosic type feed materials which include agricultural residues, dewatered sewage sludge, municipal solid waste (which is predominantly paper) and fuels derived from municipal solid wastes by shredding and various classification techniques. Also, peat is an acceptable feedstock because of its high reactivity as are lignitic coals. The tests have establish that it is possible to convert over 90 percent of the carbon in cellulosic type feed materials. However at these high carbon conversion levels, unless additional energy is available from some other source, there is not sufficient energy in the unconverted carbon to provide the heat for "gasification". Therefore, coal or other volatile containing carbonaceous materials can be used to supplement the cellulosic type feeds because the volatile portion of the coal will be converted to gas and the remaining char will provide sufficient heat to gasify nearly all of the cellulosic feed as well as the volatiles in the coal.

Introduction of all these materials can be accomplished, as in the pilot plant, by completely conventional means such as screw feeders, solid metering valves, or pneumatic conveying.

While particular embodiments of the invention have been shown and described, it will be obvious to those skilled in the art that various changes and modifications may be made without departing from the essential features of the present invention and, therefore, the aim in the appended claims is to cover all such changes and modifications as fall within the true spirit and scope of the invention.

We claim:

1. A method of operating a gasifier which comprises:
a. introducing inlet gas at a gas velocity of about 0.5 to 7 ft/sec to fluidize a bed in a gasifier vessel;
b. forming the bed into a fluidized bed in a first space region by means of the inlet gas, the fluidized bed containing a circulating hot relatively fine and inert solid bed particle component;
c. inputting and throughputting carbonaceous material into and through the first space region with fluidized bed at a rate from 500–4400 lbs/ft$^2$-hr;
d. endothermally pyrolyzing the carbonaceous material by means of the circulating hot inert particle component so as to form a product gas;
e. forming contiguous to and above the fluidized bed a lower average density entrained space region containing an entrained mixture of inert solid particles, char, and carbonaceous material and the product gas;

f. gradually and continuously removing the entrained mixture and the product gas from the lower average density entrained space region of the gasifier to a separator, residence time of the carbonaceous material in the gasifier not exceeding 3 minutes on average;

g. separating the entrained mixture from the product gas;

h. passing the entrained mixture containing inert solid particles char, and carbonaceous material through an exothermic reaction zone to add heat;

i. returning at least the inert solid particles to the first space region; and wherein the gasifier is operated at a pressure between atmospheric and 100 psia and wherein the inlet gas velocity in step (a) has an inverse relationship to the rate of inputting carbonaceous material in step (c).

2. The method according to claim 1 wherein the carbonaceous material is inputted into the first space region with dense fluid bed at a rate exceeding 3000 $lb/ft^2$-hr.

3. The method according to claim 1 wherein the relatively inert solid bed particle component is selected from the group consisting of sand, limestone, metal oxides, and calcite.

4. The method according to claim 1 wherein after separating the entrained mixture from the product gas, the entrained mixture is passed through an exothermic reaction zone of a combustor.

5. The method according to claim 1 wherein separating the entrained mixture from the product gas is accomplished using a cyclone separator.

6. The method according to claim 1, wherein the gasifier vessel has an L/D ratio above 6.

7. The method according to claim 1 wherein the inlet gas introduced is selected from the group consisting of steam, recycled product gas, and mixtures thereof.

8. The method according to claim 1 wherein the gasifier is operated at a pressure between atmospheric pressure and 30 psia.

* * * * *

UNITED STATES PATENT AND TRADEMARK OFFICE

CERTIFICATE OF CORRECTION

PATENT NO. : 4,828,581

DATED : May 9, 1989

INVENTOR(S) : Herman F. Feldmann and Mark A. Paisley

It is certified that error appears in the above—identified patent and that said Letters Patent is hereby corrected as shown below:

Column 2, line 30, delete "and";

Column 5, line 52, "in" should read -- is --;

Column 9, line 37, "it" should read -- its --; and

Column 11, line 1, "=" should read -- X --.

Signed and Sealed this

Thirteenth Day of March, 1990

*Attest:*

JEFFREY M. SAMUELS

*Attesting Officer*

*Acting Commissioner of Patents and Trademarks*